US010262513B1

(12) United States Patent
Huang et al.

(10) Patent No.: US 10,262,513 B1
(45) Date of Patent: Apr. 16, 2019

(54) LIGHT EMITTING DEVICE

(71) Applicant: Chicony Power Technology Co., Ltd., New Taipei (TW)

(72) Inventors: Huan-Hsiang Huang, New Taipei (TW); Kui-Chih Su, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/856,039

(22) Filed: Dec. 27, 2017

(30) Foreign Application Priority Data

Oct. 13, 2017 (CN) ..... 2017 1 0954451

(51) Int. Cl.

| | |
|---|---|
| ***G08B 17/10*** | (2006.01) |
| ***H05B 33/08*** | (2006.01) |
| ***G08B 21/18*** | (2006.01) |
| ***G08B 5/38*** | (2006.01) |

(52) U.S. Cl.
CPC ..... *G08B 17/10* (2013.01); *G08B 5/38* (2013.01); *G08B 21/182* (2013.01); *H05B 33/0824* (2013.01); *H05B 33/0854* (2013.01)

(58) Field of Classification Search
CPC ..... G08B 17/10; G08B 21/182
See application file for complete search history.

(56) References Cited

U.S. PATENT DOCUMENTS 5,146,209 A * 9/1992 Beghelli ..... G08B 7/062 340/628
7,034,506 B2 4/2006 Chen et al.
8,519,626 B2 8/2013 Leshniak et al.
2009/0154148 A1* 6/2009 Meyer ..... F21L 2/00 362/157
2012/0126700 A1* 5/2012 Mayfield ..... H05B 37/0272 315/86
2013/0113393 A1* 5/2013 Fujita ..... F21S 9/022 315/297
2015/0015076 A1 1/2015 Park
2015/0296586 A1* 10/2015 Williams ..... H05B 37/0245 315/161

(Continued)

FOREIGN PATENT DOCUMENTS

CN 201651865 U 11/2010
TW M349462 U 1/2009

(Continued)

*Primary Examiner* — Laura N Nguyen
(74) *Attorney, Agent, or Firm* — CKC & Partners Co., LLC

(57) ABSTRACT

A light emitting device includes several light emitting diode unit groups, a battery, a microprocessor, and a smoke detector is disclosed. When the light emitting diode unit groups receive power supplied from an external power supply, the external power supply charges the battery through the part of the plurality of light emitting diode unit groups, and the external power supply drives at least one of the plurality of light emitting diode unit groups. When the light emitting diode unit groups do not receive the power supplied from the external power supply, the battery discharges to drive the at least one of the plurality of light emitting diode unit groups. When the smoke detector detects that a smoke concentration in an environment exceeds a preset value, the microprocessor sends a flickering signal so that the at least one of the plurality of light emitting diode unit groups flickers.

10 Claims, 3 Drawing Sheets

(56) References Cited

U.S. PATENT DOCUMENTS

| | | | | |
|---|---|---|---|---|
| 2016/0141915 | A1* | 5/2016 | Descarries | H02J 7/04 315/86 |
| 2016/0148472 | A1* | 5/2016 | Hsu | G08B 5/36 362/231 |
| 2016/0328928 | A1* | 11/2016 | Lutz | G08B 5/36 |
| 2017/0093210 | A1* | 3/2017 | Recker | H02J 9/065 |
| 2017/0219234 | A1* | 8/2017 | Bhide | H02J 9/06 |
| 2017/0279300 | A1* | 9/2017 | Catalano | H02J 7/0068 |
| 2018/0082685 | A1* | 3/2018 | Carlin | G10L 15/22 |

FOREIGN PATENT DOCUMENTS

| | | | |
|---|---|---|---|
| TW | 200936945 | A | 9/2009 |
| TW | M433508 | U1 | 7/2012 |
| TW | M518297 | U | 3/2016 |
| TW | M528402 | U | 9/2016 |

* cited by examiner

LIGHT EMITTING DEVICE

CROSS-REFERENCE TO RELATED APPLICATION

This application claims the priority benefit of Chinese Application serial no. 201710954451.2, filed Oct. 13, 2017, the full disclosure of which is incorporated herein by reference.

FIELD OF INVENTION

The invention relates to a light emitting device. More particularly, the invention relates to a light emitting device for smoke detection.

BACKGROUND

The main function of emergency lighting is to provide users with emergency lighting when an emergency situation such as mains interruption occurs to reduce the occurrence of an accident. In general, in general lighting, electricity is supplied to the light emitting device from the mains, and when the emergency lighting is in need, the battery is used to supply power to the light emitting device.

If the traditional general lighting device needs to have the function of emergency lighting as well, in addition to the original general lighting light emitting diodes and circuits, another set of battery charging circuits and another set of light emitting diodes for emergency lighting are also in need, which may cause the lighting device to be too bulky. Furthermore, in addition to the function of emergency lighting, the functions of smoke detection and smoke concentration warning are also important. However, the general emergency lighting device does not have the function integrating general lighting, emergency lighting, smoke detection and smoke concentration warning at the same time.

Therefore, how to effectively integrate the functions of general lighting, emergency lighting, smoke detection and smoke concentration warning, and reducing the volume of the lighting device, are problems to be improved in the field.

SUMMARY

An embodiment of this disclosure is to provide a light emitting device. The light emitting device includes a plurality of light emitting diode unit groups, a battery, a microprocessor, and a smoke detector. The light emitting diode unit groups connect in series with each other. Each of the plurality of light emitting diode unit groups includes at least one light emitting diode unit. The battery is coupled to a part of the light emitting diode unit groups. The microprocessor is driven by the battery. The smoke detector is coupled to the microprocessor. When the light emitting diode unit groups receive power supplied from an external power supply, the external power supply charges the battery through the part of the plurality of light emitting diode unit groups, and the external power supply drives at least one of the plurality of light emitting diode unit groups. When the light emitting diode unit groups do not receive the power supplied from the external power supply, the battery discharges to drive the at least one of the plurality of light emitting diode unit groups. When the smoke detector detects that a smoke concentration in an environment exceeds a preset value, the microprocessor sends a flickering signal so that the at least one of the plurality of light emitting diode unit groups flickers.

According to the technical aspect of the present disclosure, the embodiments of the present disclosure provide a light emitting device, so that the conventional light emitting diode for general lighting is used as a light emitting diode for emergency lighting in an emergency situation, and the volume of the light emitting device is effectively reduced. In some embodiments of the present disclosure, the battery is charged by using the conventional light emitting diode circuit for general lighting, so that no additional switching power supply is needed, and the complexity of the circuit is effectively reduced. Furthermore, in addition to the general lighting function and the emergency lighting function, the embodiments of the present disclosure also have a smoke detection and smoke concentration warning function. In the case of emergency lighting, only part of the light emitting diode unit groups may be flickering, which reduces the power consumption, in order to extend the lighting time. Furthermore, since the power source of the microprocessor is a battery, the operation of the smoke detecting circuit is not affected by whether the external power supply exists or not.

It is to be understood that both the foregoing general description and the following detailed description are by examples, and are intended to provide further explanation of the present disclosure as claimed.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILIGHT EMITTING DIODES DESCRIPTION

In order to make the description of the disclosure more detailed and comprehensive, reference will now be made in detail to the accompanying drawings and the following embodiments. However, the provided embodiments are not used to limit the ranges covered by the present disclosure; orders of step description are not used to limit the execution sequence either. Any devices with equivalent effect through rearrangement are also covered by the present disclosure.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

In this document, the term "coupled" may also be termed as "electrically coupled," and the term "connected" may be termed as "electrically connected." "Coupled" and "connected" may also be used to indicate that two or more elements cooperate or interact with each other.

Figure 1:
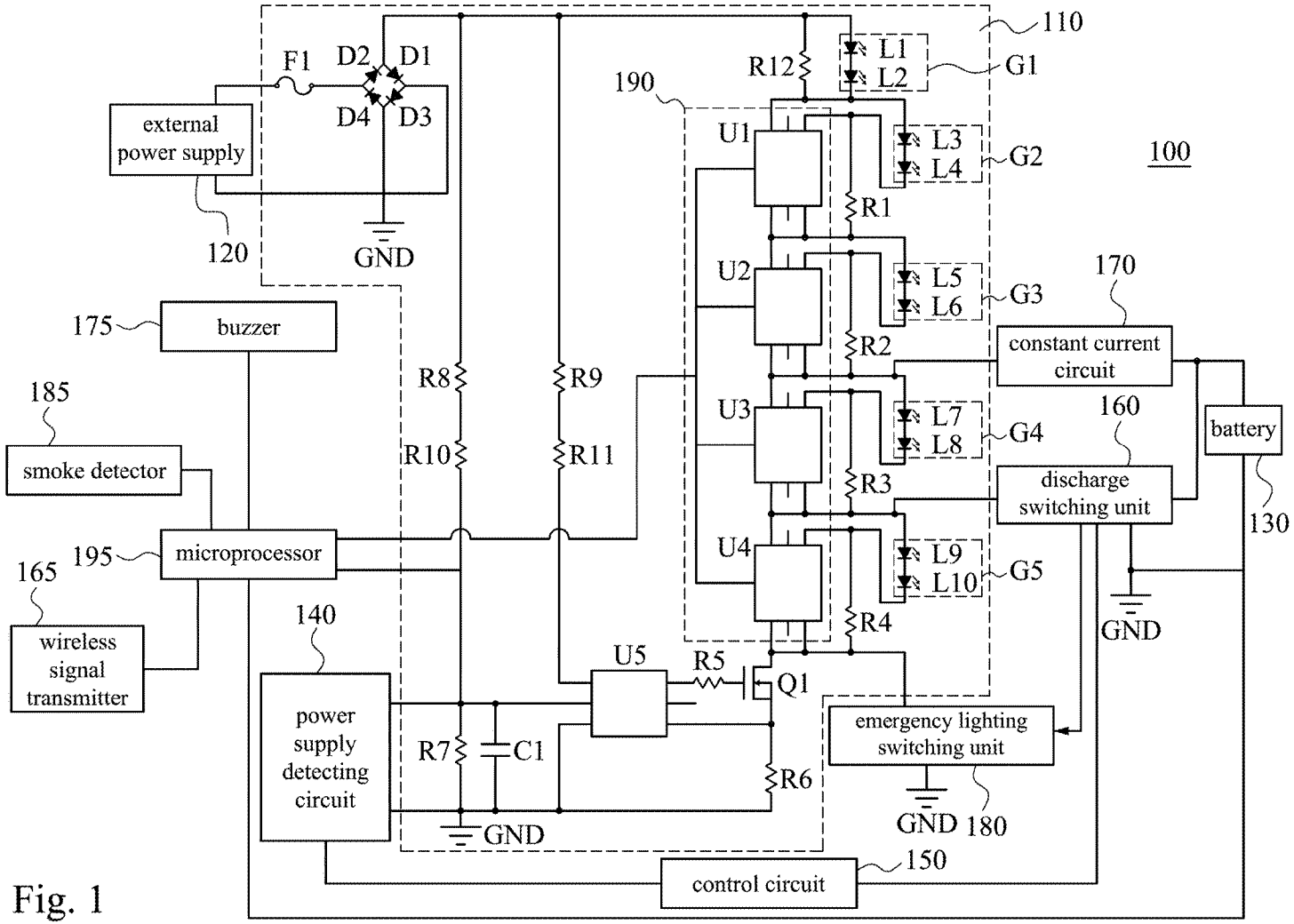
FIG. 1 is a schematic diagram illustrating a light emitting device according to some embodiments of the present disclosure.

FIG. 1 is a schematic diagram illustrating a light emitting device according to some embodiments of the present disclosure. The light emitting device 100 includes a light emitting diode power supply 110. As shown in FIG. 1, the light emitting diode power supply 110 includes several light emitting diode unit groups G1-G5. Each of the light emitting diode unit groups G1-G5 includes at least one light emitting diode. As shown in FIG. 1, the light emitting diode unit group G1 includes light emitting diode units L1 and L2. The light emitting diode unit group G2 includes light emitting diode units L3 and L4. The light emitting diode unit group G3 includes light emitting diode units L5 and L6. The light emitting diode unit group G4 includes light emitting diode units L7 and L8. The light emitting diode unit group G5 includes light emitting diode units L9 and L10. The light emitting diode unit groups G1-G5 are connected in series to each other. In some embodiments, the light emitting diode power supply 110 may be the light emitting diode power supply for general lighting. The number of the light emitting diode unit groups and the number of the light emitting diode units shown in FIG. 1 is only for illustrative purposes, and the present disclosure is not limited thereto.

As shown in FIG. 1, in some embodiments, the light emitting diode power supply 110 further includes a light source control unit 190, resistors R1-R12, a transistor Q1, diodes D1-D4, a fuse F1, a capacitor C1, a chip U5, and a ground GND. The light emitting diode power supply 110 shown in FIG. 1 is an AC Direct light emitting diode power supply, but the present disclosure is not limited thereto.

As shown in FIG. 1, the light emitting diode power supply 110 is coupled to the external power supply 120. In some embodiments, the external power supply 120 may be AC mains.

In some embodiments, the light emitting device 100 includes a battery 130, and the battery 130 is coupled to a part of the light emitting diode unit groups G1-G5. For example, as shown in FIG. 1, the battery 130 is coupled to the light emitting diode unit group G4 and the light emitting diode unit group G5.

When the light emitting diode unit groups G1-G5 receive the power supplied by the external power supply 120, the external power supply 120 passes through a part of the light emitting diode unit groups G1-G5 to charge the battery 130 and drives at least one of the light emitting diode unit groups G1-G5 to illuminate at least one of the light emitting diode unit groups G1-G5. For example, as shown in FIG. 1, when the light emitting diode unit groups G1-G5 receive the power supplied by the external power supply 120, the external power supply 120 passes through the light emitting diode unit groups G1-G3 to charge the battery 130.

When the light emitting diode unit groups G1-G5 does not receive the power supplied by the external power supply 120, the battery 130 discharges to drive at least one of the light emitting diode unit groups G1-G5. For example, as shown in FIG. 1, when the light emitting diode unit groups G1-G5 do not receive the power supplied by the external power supply 120, the battery 130 discharges to drive the light emitting diode unit group G5 for emergency lighting.

In some embodiments, the light emitting device 100 includes a microprocessor 195 and a smoke detector 185. The microprocessor 195 is coupled to the battery 130, the light source control unit 190 and the power supply detecting circuit 140. Microprocessor 195 is driven by battery 130. The smoke detector 185 is coupled to the microprocessor 195. When the smoke detector 185 detects that the smoke concentration in the environment exceeds a preset value, the microprocessor 195 sends a flickering signal to flicker at least one of the light emitting diode unit groups G1-G5.

In some embodiments, the light emitting device 100 further includes a power supply detecting circuit 140. The power supply detecting circuit 140 detects whether the external power supply 120 exists or not. In some embodiments, the power supply detecting circuit 140 detects whether the light emitting diode unit groups G1-G5 receive the power supplied by the external power supply 120 or not. When the detecting result of the power supply detecting circuit 140 is that the external power supply 120 exists (for example, the external power supply 120 supplies power), the external power supply 120 passes through a part of the light emitting diode unit groups G1-G5 to charge the battery 130. When the detecting result of the power supply detecting circuit 140 is that the external power supply does not exist (for example, the external power supply 120 does not supply power), the power supply detecting circuit 140 discharges the battery 130 to drive the at least one of the light emitting diode unit groups G1-G5.

In some embodiments, the light emitting device 100 further includes a light source control unit 190. The light source control unit 190 includes several switching units U1-U4. The switching units U1-U4 are respectively coupled to at least one of the light emitting diode unit groups G1-G5. For example, as shown in FIG. 1, the switching unit U1 is coupled to the light emitting diode unit group G2, the switching unit U2 is coupled to the light emitting diode unit group G3, the switching unit U3 is coupled to the light emitting diode unit group G4. The switching unit U4 is coupled to the light emitting diode unit group G5.

In some embodiments, the switching units U1-U4 are turned on or off according to the change of the voltage value of the external power supply 120. When one of the switching units U1-U4 is turned off, the external power supply 120 drives at least one light emitting diode unit group coupled to one of the switching units U1-U4. In some embodiments, when the voltage value of the external power supply 120 gradually increases, the switching units U1-U4 are turned off one by one. When the voltage value of the external power supply 120 gradually decreases, the switching units U1-U4 are turned on one by one.

In some embodiments, when the switching units U1-U4 are turned on, the current flows through the switching units U1-U4 without flowing through the light emitting diode unit groups G2-G5, and the light emitting diode unit groups G2-G5 are not driven. When the switching unit U1 is turned off, the current does not flow through the switching unit U1 but flows through the light emitting diode unit group G2 to drive the light emitting diode unit group G2. When the switching units U1 and U2 are turned off, the current does not flow through the switching units U1 and U2 but flows through the light emitting diode unit groups G2 and G3 to drive the light emitting diode unit groups G2 and G3. When the switching units U1, U2, and U3 are turned off, the current does not flow through the switching units U1, U2, and U3 but flows through the light emitting diode unit groups G2, G3, G4 to drive the light emitting diode unit groups G2, G3, G4. When the switching units U1, U2, U3, and U4 are turned off, the current does not flow through the switching units U1, U2, U3 and U4 but flows through the light emitting diode unit groups G2, G3, G4 and G5 to drive the light emitting diode unit groups G2, G3, G4, G5.

For example, when the voltage value of the external power supply 120 is higher than the first voltage threshold but lower than the second voltage threshold, the switching unit U1 is turned off, so that the external power supply 120 drives the light emitting diode unit group G2 coupled to the switching unit U1 and the light emitting diode unit group G1, and the switching unit U2-U4 is turned on. When the voltage value of the external power supply 120 is higher than the second voltage threshold but lower than the third voltage threshold, the switching units U1 and U2 are turned off, so that the external power supply 120 drives the light emitting diode unit groups G2 and G3 coupled to the switching units U1 and U2 and the light emitting diode unit group G1, and the switching units U3 and U4 are turned on.

When the voltage value of the external power supply 120 is higher than the third voltage threshold but lower than the fourth voltage threshold, the switching units U1, U2, and U3 are turned off, so that the external power supply 120 drives the light emitting diode unit groups G2, G3 and G4 coupled to the switching units U1, U2 and U3 and the light emitting diode unit group G1, and the switching unit U4 is turned on. When the voltage value of the external power supply 120 is higher than the fourth voltage threshold, the switching units U1-U4 are turned off, so that the external power supply 120 drives the light emitting diode unit groups G2-G5 coupled to the switching units U1-U4 and the light emitting diode unit group G1.

In some embodiments, the light emitting device 100 further includes a discharge switching unit 160. The discharge switching unit 160 is coupled between the battery 130 and at least one of the light emitting diode unit groups G1-G5. For example, as shown in FIG. 1, the discharge switching unit 160 is coupled between the battery 130 and the light emitting diode unit group G5. When the light emitting diode unit groups G1-G5 do not receive the power supplied by the external power supply 120, the discharge switching unit 160 is turned on to discharge the battery 130. When the light emitting diode unit groups G1-G5 receive the power supplied by the external power supply 120, the discharge switching unit 160 is turned off to stop the discharge of the battery 130.

In some embodiments, the light emitting device 100 further includes an emergency lighting switching unit 180. The emergency lighting switching unit 180 is coupled to the discharge switching unit 160. When the discharge switching unit 160 is turned on, the emergency lighting switching unit 180 is turned on to cause the battery 130 to drive at least one of the light emitting diode unit groups G1-G5. When the discharge switching unit 160 is turned off, the emergency lighting switching unit 180 is turned off to stop the battery 130 from driving at least one of the light emitting diode unit groups G1-G5. For example, as shown in FIG. 1, when the discharge switching unit 160 is turned on, the emergency lighting switching unit 180 is turned on, and the battery 130 drives the light emitting diode unit group G5. When the discharge switching unit 160 is turned off, the emergency lighting switching unit 180 is turned off and the battery 130 stops driving the light emitting diode unit group G5.

In some embodiments, the light emitting device 100 further includes a control circuit 150. The control circuit 150 is coupled to the power supply detecting circuit 140. When the light emitting diode unit groups G1-G5 do not receive the power supplied by the external power supply 120, the control circuit 150 turns on the discharge switching unit 160. When the light emitting diode unit groups G1-G5 receive the external power supply 120, the control circuit 150 turns off the discharge switching unit 160. In some embodiments, when the external power supply 120 does not exist, the control circuit 150 turns on the discharge switching unit 160 and the emergency lighting switching unit 180 turns on. The battery 130 discharges through the discharge switching unit 160 and the emergency lighting switching unit 180.

In some embodiments, the light emitting device 100 further includes a constant current circuit 170. The constant current circuit 170 is coupled to the battery 130 for controlling the current input to the battery 130 from the external power supply 120. In some embodiments, the constant current circuit 170 may control the magnitude of the current, the magnitude of the voltage, and/or the direction of the current input to the battery 130.

In some embodiments, after the smoke detector 185 detects the smoke concentration, the smoke detector 185 transmits the detected smoke concentration to the microprocessor 195. The microprocessor 195 determines whether the smoke concentration exceeds a preset value or not. In some embodiments, the preset value is a value stored in the microprocessor 195.

In some embodiments, when the smoke concentration detected by the smoke detector 185 exceeds the preset value and the external power supply 120 does exist, the microprocessor 195 transmits a flickering signal to the light source control unit 190, so that the light source control unit 190 controls at least one of the light emitting unit groups G1-G5 to flicker.

In some embodiments, when the smoke concentration detected by the smoke detector 185 exceeds a preset value and the external power supply 120 does not exist, the microprocessor 195 transmits a flickering signal to the power supply detecting circuit 140. After the power supply detecting circuit 140 receives the flickering signal, the power supply detecting circuit 140 transmits information to the control circuit 150, which turns on the discharge switching unit 160, and further turns on the emergency lighting switching unit 180 through the discharge switching unit 160. The battery 130 drives the light emitting diode unit group G5 and flickers the light emitting diode unit group G5.

In some embodiments, the light emitting device 100 further includes a buzzer 175. The buzzer 175 is coupled to the microprocessor 195. When the smoke concentration detected by the smoke detector 185 exceeds the preset value, the buzzer 175 issues a warning sound.

In some embodiments, the light emitting device 100 further includes a wireless signal transmitter 165. The wireless signal transmitter 165 is coupled to the microprocessor 195. When the smoke concentration detected by the smoke detector 185 exceeds the preset value, the wireless signal transmitter 165 sends a wireless signal to transmit the warning message to a wireless receiving device (not shown).

Figure 2:
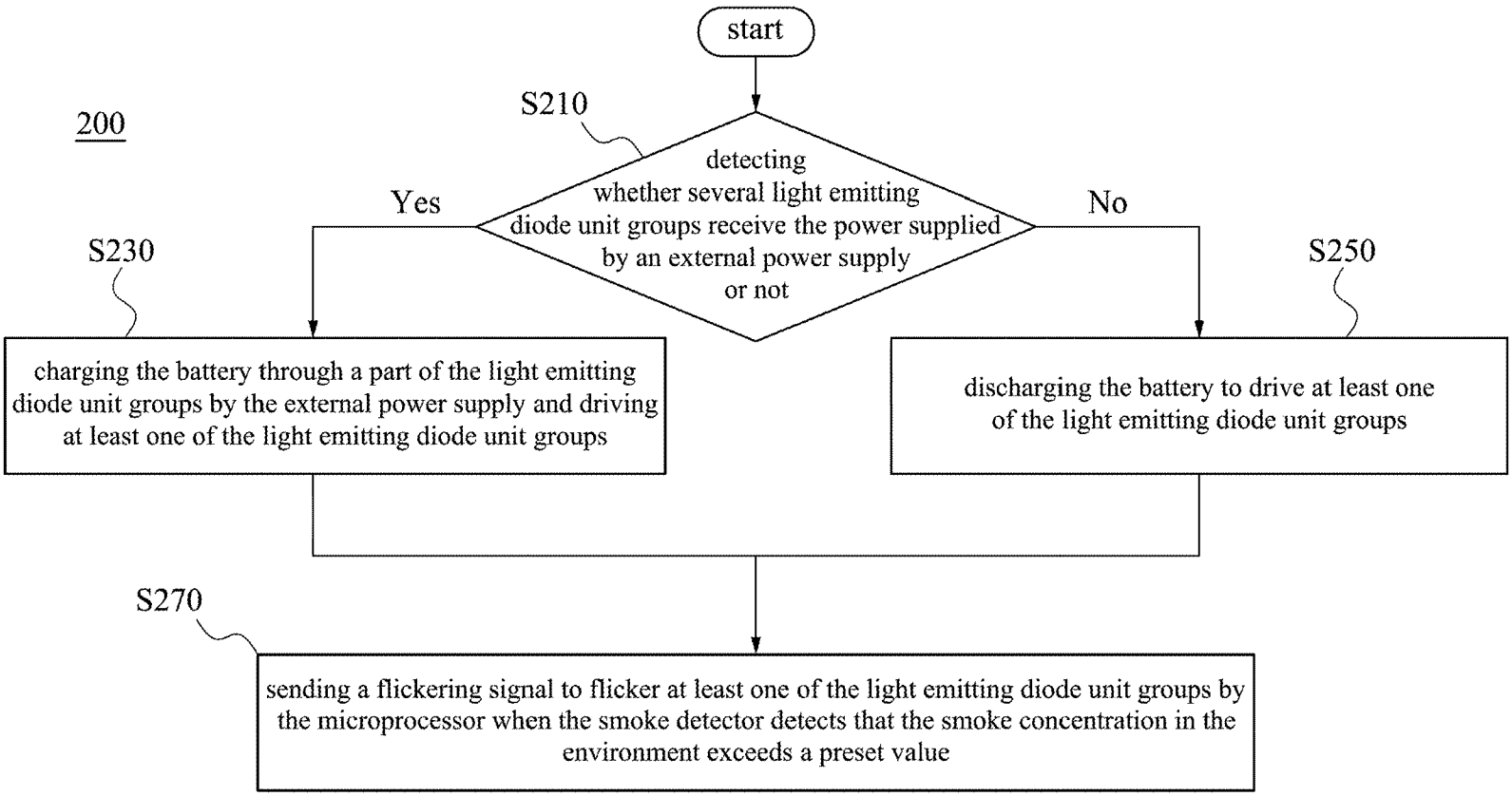
FIG. 2 is a flow diagram illustrating a driving method of a light emitting device according to some embodiments of the present disclosure.

Reference is made to FIG. 2. FIG. 2 is a flow diagram illustrating a driving method 200 of a light emitting device according to some embodiments of the present disclosure. The driving method 200 of the light emitting device includes the following operations:

Operation S210: detecting whether several light emitting diode unit groups receive the power supplied by an external power supply or not;

Operation S230: charging the battery through a part of the light emitting diode unit groups by the external power supply and driving at least one of the light emitting diode unit groups;

Operation S250: discharging the battery to drive at least one of the light emitting diode unit groups; and Operation S270: sending a flickering signal to flicker at least one of the light emitting diode unit groups by the microprocessor when the smoke detector detects that the smoke concentration in the environment exceeds a preset value.

For ease of understanding the driving method 200 of the light emitting device of the embodiment of the present disclosure, reference is made to FIG. 1 and FIG. 2.

In operation S210, detecting whether several light emitting diode unit groups receive the power supplied by an external power supply or not. In some embodiments, the light emitting diode unit groups G1-G5 may receive the power supplied by the external power supply 120 when the external power supply 120 does exist. When the external power supply 120 does not exist, the light emitting diode unit groups G1-G5 do not receive the power supplied by the external power supply 120.

In some embodiments, whether the light emitting diode unit groups G1-G5 receive the power supplied by the external power supply 120 or not may be detected by the power supply detecting circuit 140 of FIG. 1. If the result of operation S210 is that the light emitting diode unit groups G1-G5 receive the power supplied by the external power supply 120, operation S230 is performed. If the result of operation S210 is that the light emitting diode unit groups G1-G5 do not receive the power supplied by the external power supply 120, operation S250 is performed.

In operation S230, charging the battery through a part of the light emitting diode unit groups by the external power supply and driving at least one of the light emitting diode unit groups. For example, reference is made to FIG. 1, when the detecting result of the power supply detecting circuit 140 is that the light emitting diode unit groups G1-G5 receive the power supplied by the external power supply 120, the external power supply 120 passes through the light emitting diode unit group G1-G3 to charge the battery 130 and drives the light emitting diode unit groups G1-G5 so as to make the light emitting diode unit groups G1-G5 glow.

In operation S250, discharging the battery to drive at least one of the light emitting diode unit groups. For example, reference is made to FIG. 1. When the detecting result of the power supply detecting circuit 140 is that the light emitting diode unit groups G1-G5 do not receive the power supplied by the external power supply 120, the battery 130 discharges to drive the light emitting diode unit group G5.

In operation S270, sending a flickering signal to flicker at least one of the light emitting diode unit groups by the microprocessor when the smoke detector detects that the smoke concentration in the environment exceeds a preset value. For example, reference is made to FIG. 1. When the smoke detector 185 detects that the smoke concentration in the environment exceeds a preset value, the microprocessor 195 sends a flickering signal to make at least one of the light emitting diode unit groups G1-G5 flicker.

In some embodiments, in operation S270, when the smoke concentration detected by the smoke detector 185 exceeds a preset value and the external power supply 120 does exist, the microprocessor 195 transmits a flickering signal to the light source control unit 190, so as to make the light source control unit 190 control at least one of the light emitting diode unit groups G1-G5 to flicker. When the smoke detector detects that the smoke concentration exceeds a preset value and the external power supply 120 does not exist, the microprocessor 195 sends a flickering signal to the power supply detecting circuit 140. After the power supply detecting circuit 140 receives the flickering signal, the power supply detecting circuit 140 transmits the information to the control circuit 150. The control circuit 150 turns on the discharge switching unit 160 and turns on the emergency lighting switching unit 180 through the discharge switching unit 160, so that the battery 130 drives the light emitting diode unit group G5 and flickers the light emitting diode unit group G5.

In some embodiments, the operation S270 further includes sending a warning sound by the buzzer 175 when the smoke concentration detected by the smoke detector 185 exceeds a preset value. In some embodiments, when the smoke concentration detected by the smoke detector 185 exceeds a preset value, the microprocessor 195 sends a message to the buzzer 175 to make the buzzer 175 issue a warning sound.

In some embodiments, operation S270 further includes sending a wireless signal by the wireless signal transmitter 165 to transmit the warning message to the wireless receiving device when the smoke concentration detected by the smoke detector 185 exceeds a preset value. In some embodiments, when the smoke concentration detected by the smoke detector 185 exceeds a preset value, the microprocessor 195 transmits the information to the wireless signal transmitter 165, so that the wireless signal transmitter 165 transmits the warning message to a wireless receiving device.

Figure 3:
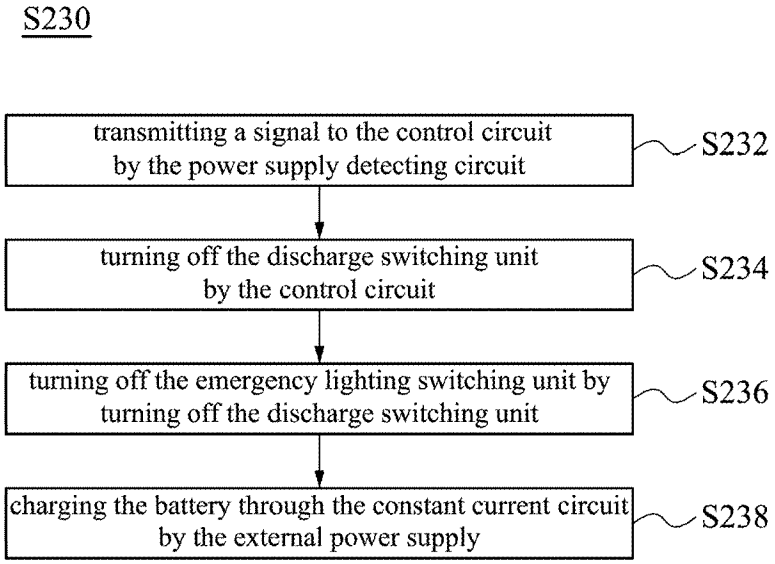
FIG. 3 is a flow chart illustrating one operation in the method of FIG. 2 according to some embodiments of the present disclosure.

Reference is made to FIG. 3. FIG. 3 is a flow chart illustrating operation S230 in the method of FIG. 2 according to some embodiments of the present disclosure. Operation S230 includes the following operations:

Operation S232: transmitting a signal to the control circuit by the power supply detecting circuit;

Operation S234: turning off the discharge switching unit by the control circuit;

Operation S236: turning off the emergency lighting switching unit by turning off the discharge switching unit; and Operation S238: charging the battery through the constant current circuit by the external power supply.

In operation S232, transmitting a signal to the control circuit by the power supply detecting circuit. For example, reference is made to FIG. 1, when the detecting result of the power supply detecting circuit 140 is that the light emitting diode unit groups G1-G5 receive the power supplied by the external power supply 120, the power supply detecting circuit 140 transmits the detecting result to the control circuit 150.

In operation S234, turning off the discharge switching unit by the control circuit. For example, reference is made to FIG. 1. The control circuit 150 may control to turn off the discharge switching unit 160.

In operation S236, turning off the emergency lighting switching unit by turning off the discharge switching unit. For example, reference is made to FIG. 1. When the discharge switching unit 160 is turned off, the discharge switching unit 160 may turn off the emergency lighting switching unit 180 to stop the battery 130 from driving the light emitting diode unit groups G1-G5.

In operation S238, charging the battery through the constant current circuit by the external power supply. For example, reference is made to FIG. 1. The external power supply 120 may charge the battery 130 through the light emitting diode unit groups G1-G3 and the constant current circuit 170.

Figure 4:
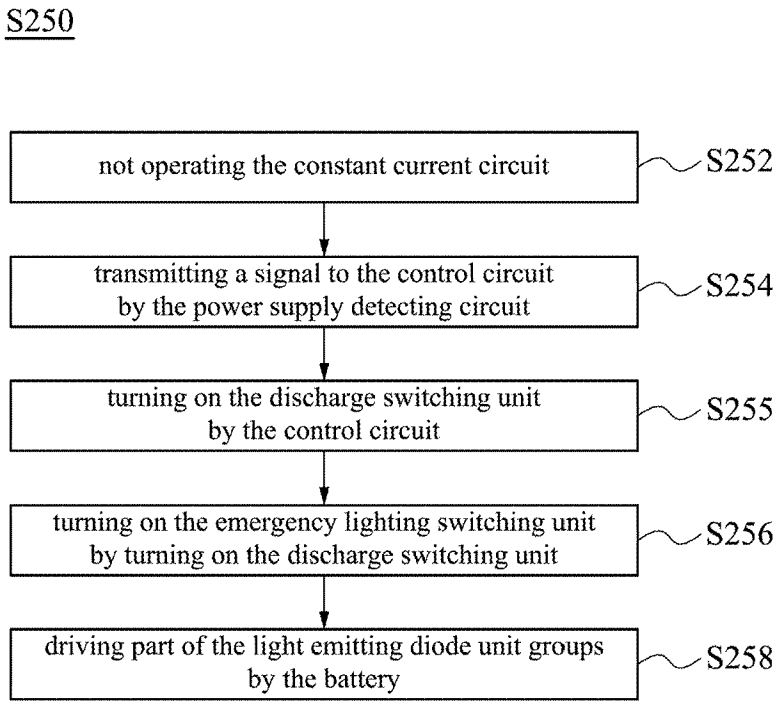
FIG. 4 is a flow chart illustrating one operation in the method of FIG. 2 according to some embodiments of the present disclosure.

Reference is made to FIG. 4. FIG. 4 is a flow chart illustrating operation S250 in FIG. 2 according to some embodiments of the present disclosure. Operation S250 includes the following operations:

Operation S252: not operating the constant current circuit;

Operation S254: transmitting a signal to the control circuit by the power supply detecting circuit;

Operation S255: turning on the discharge switching unit by the control circuit;

Operation S256: turning on the emergency lighting switching unit by turning on the discharge switching unit; and Operation S258: driving part of the light emitting diode unit groups by the battery.

In operation S252, not operating the constant current circuit. For example, reference is made to FIG. 1. When the external power supply 120 does not supply power to the light emitting diode unit groups G1-G5, the constant current circuit 170 does not operate and the battery 130 is not charged.

In operation S254, transmitting a signal to the control circuit by the power supply detecting circuit. For example, reference is made to FIG. 1. When the detecting result of the power supply detecting circuit 140 is that the light emitting diode unit groups G1-G5 do not receive the power supplied from the external power supply 120, the power supply detecting circuit 140 transmits the detecting result to the control circuit 150.

In operation S255, turning on the discharge switching unit by the control circuit. For example, reference is made to FIG. 1. The control circuit 150 may control to turn on the discharge switching unit 160.

In operation S256, turning on the emergency lighting switching unit by turning on the discharge switching unit. For example, reference is made to FIG. 1. When the discharge switching unit 160 is turned on, the discharge switching unit 160 may turn on the emergency lighting switching unit 180.

In operation S258, driving part of the light emitting diode unit groups by the battery. For example, reference is made to FIG. 1. When the discharge switching unit 160 is turned on and the emergency lighting switching unit 180 is turned on, the battery 130 drives the light emitting diode unit group G5.

In some embodiments, the light emitting diode power supply 110 may be a device or a circuit with the function of driving the light emitting diodes unit groups G1-G5 or other equivalent functions. In some embodiments, the battery 130 may be a battery or other equivalent function device or circuit having the functions of charging and discharging. In some embodiments, the microprocessor 195 may be a device or circuit having the functions of storage, computing, data transmission and reception, or other equivalent functions.

The light emitting device 100 described above are merely for illustrative purposes, and the present disclosure is not limited thereto.

According to the embodiments of the present disclosure, it is understood that the embodiments of the present disclosure is to provide a light emitting device, whereby the conventional light emitting diode for general lighting is used as a light emitting diode for emergency lighting in an emergency situation, so as to effectively reduce the volume of the light emitting device. In some embodiments of the present disclosure, the battery is charged by using the conventional light emitting diode circuit for general lighting, so that no additional switching power supply is needed, and the circuit complexity may be effectively reduced. Furthermore, in addition to the general lighting function and the emergency lighting function, the embodiments of the present disclosure also includes functions of smoke detection and smoke concentration warning. In the case of emergency lighting, only part of the light emitting diode units may be flickering, which may reduce the power consumption, in order to extend lighting time of the light emitting diode. Furthermore, since the power source of the microprocessor is a battery, the operation of the smoke detecting circuit is not affected by whether the external power supply exists or not.

Although the present disclosure has been described in considerable detail with reference to certain embodiments thereof, other embodiments are possible. Therefore, the spirit and scope of the appended claims should not be limited to the description of the embodiments contained herein.

In addition, the above illustrations comprise sequential demonstration operations, but the operations need not be performed in the order shown. The execution of the operations in a different order is within the scope of this disclosure. In the spirit and scope of the embodiments of the present disclosure, the operations may be increased, substituted, changed and/or omitted as the case may be.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A light emitting device, comprising:

a plurality of light emitting diode unit groups connected in series with each other, wherein each of the plurality of light emitting diode unit groups includes at least one light emitting diode unit;

a battery coupled to a part of the light emitting diode unit groups;

a microprocessor driven by the battery; and a smoke detector coupled to the microprocessor;

wherein when the light emitting diode unit groups receive power supplied from an external power supply, the external power supply charges the battery through the part of the plurality of light emitting diode unit groups, and the external power supply drives at least one of the plurality of light emitting diode unit groups;

wherein when the light emitting diode unit groups do not receive the power supplied from the external power supply, the battery discharges to drive the at least one of the plurality of light emitting diode unit groups;

wherein when the smoke detector detects that a smoke concentration in an environment exceeds a preset value, the microprocessor sends a flickering signal so that the at least one of the plurality of light emitting diode unit groups flickers.

2. The light emitting device of claim 1, further comprising:

a power supply detecting circuit configured for detecting whether the external power supply exists or not;

wherein when the external power supply exists, the external power supply charges the battery through the part of the plurality of light emitting diode unit groups; when the external power supply does not exist, the power supply detecting circuit discharges the battery.

3. The light emitting device of claim 1, further comprising:

a light source control unit comprising a plurality of switching units, wherein the plurality of switching units couple to the at least one of the plurality of light emitting diode unit groups, respectively, and the plurality of switching units turn on or off according to a change of a voltage value of the external power supply;

wherein when one of the plurality of switching units is turned off, the external power supply drives the at least one of the light emitting diode unit groups coupled to the one of the plurality of switching units.

4. The light emitting device of claim 3, wherein the microprocessor transmits the flickering signal to the light source control unit when the smoke concentration exceeds the preset value and the external power supply exists; the microprocessor transmits the flickering signal to a power supply detecting circuit when the smoke concentration exceeds the preset value and the external power supply does not exist.

5. The light emitting device of claim 3, wherein the plurality of switching units are turned off one by one when the voltage value of the external power supply is gradually increased; the plurality of switching units are turned on one by one when the voltage value of the external power supply is gradually decreased.

6. The light emitting device of claim 2, further comprising:

a discharge switching unit coupled between the battery and the at least one of the plurality of light emitting diode unit groups;

an emergency lighting switching unit coupled to the discharge switching unit; and a control circuit coupled to the power supply detecting circuit;

wherein when the external power supply does not exist, the control circuit turns on the discharge switching unit, the emergency lighting switching unit is turned on, and the battery discharges through the discharge switching unit and the emergency lighting switching unit.

7. The light emitting device of claim 6, further comprising:

a constant current circuit coupled between the battery and the at least one of the plurality of light emitting diode unit groups;

wherein when the external power supply exists, the control circuit turns off the discharge switching unit, the emergency lighting switching unit is turned off, and the external power supply charges the battery through the constant current circuit.

8. The light emitting device of claim 1, further comprising:

a buzzer coupled to the microprocessor, wherein when the smoke concentration exceeds the preset value, the buzzer issues a warning sound.

9. The light emitting device of claim 1, further comprising:

a wireless signal transmitter coupled to the microprocessor, wherein when the smoke concentration exceeds the preset value, the wireless signal transmitter sends a wireless signal.

10. The light emitting device of claim 1, wherein the microprocessor is further configured for determining whether the smoke concentration exceeds the preset value or not.

* * * * *